US009342051B2

(12) United States Patent
Cattaneo et al.

(10) Patent No.: US 9,342,051 B2
(45) Date of Patent: May 17, 2016

(54) WATCH WITH A RIGID CASING-UP, AND CASING-UP METHOD

(75) Inventors: Julien Cattaneo, Esery (FR); Marco La China, Geneva (CH)

(73) Assignee: ROLEX S.A., Geneva (CH)

( * ) Notice: Subject to any disclaimer, the term of this patent is extended or adjusted under 35 U.S.C. 154(b) by 0 days.

(21) Appl. No.: 13/885,440

(22) PCT Filed: Nov. 24, 2011

(86) PCT No.: PCT/CH2011/000283

§ 371 (c)(1),
(2), (4) Date: Jul. 3, 2013

(87) PCT Pub. No.: WO2012/068696

PCT Pub. Date: May 31, 2012

(65) Prior Publication Data

US 2013/0286798 A1 Oct. 31, 2013

(30) Foreign Application Priority Data

Nov. 25, 2010 (EP) ..... 10405228

(51) Int. Cl.

| | |
|---|---|
| ***G04B 37/05*** | (2006.01) |
| ***G04B 37/08*** | (2006.01) |
| ***G04B 43/00*** | (2006.01) |

(52) U.S. Cl.

CPC ..... *G04B 37/05* (2013.01); *G04B 37/052* (2013.01); *G04B 37/084* (2013.01); *G04B 43/002* (2013.01); *Y10T 29/49584* (2015.01)

(58) Field of Classification Search

CPC ..... G04B 37/05; G04B 37/08; G04B 43/00; G04B 37/052; G04B 37/084; G04B 43/002; Y10T 29/49584

USPC ..... 368/297, 299, 300, 309, 289, 281

See application file for complete search history.

(56) References Cited

U.S. PATENT DOCUMENTS

| | | | | |
|---|---|---|---|---|
| 353,961 | A | 12/1886 | O'Hara | |
| 557,444 | A * | 3/1896 | Smith | 206/18 |

(Continued)

FOREIGN PATENT DOCUMENTS

| | | |
|---|---|---|
| CH | 280 886 A | 2/1952 |
| CH | 356 411 A | 8/1961 |

(Continued)

OTHER PUBLICATIONS

International Search Report for PCT/CH2011/000283, mailing date of Jun. 1, 2012.

(Continued)

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

The invention relates to a watch with a rigid casing-up, comprising: a middle (1); a bottom (2); a movement (3, 3*bis*, 3*ter*, 3*quater*, 41); and a casing-up ring (4, 4*bis*, 4*ter*, 42) in contact with the middle (1). The casing-up ring (4, 4*bis*, 4*ter*, 42) has an inner peripheral face (8, 17) and the movement (3, 3*bis*, 3*ter*, 3*quater*, 41) is secured to an outer peripheral face (7, 13, 18, 18*bis*), said inner (8, 17) and outer (7, 13, 1, 18*bis*) peripheral faces being in contact with each other in the Z and Z' regions thereof. Said watch is characterized in that it also comprises a tightening element (5, 5*bis*) provided for exerting pressure on the casing-up ring (4, 4*bis*, 4*ter*, 42) or the movement (3*quater*). The invention also relates to a method for casing-up such a watch.

24 Claims, 13 Drawing Sheets

(56) References Cited

U.S. PATENT DOCUMENTS

Figure 1:
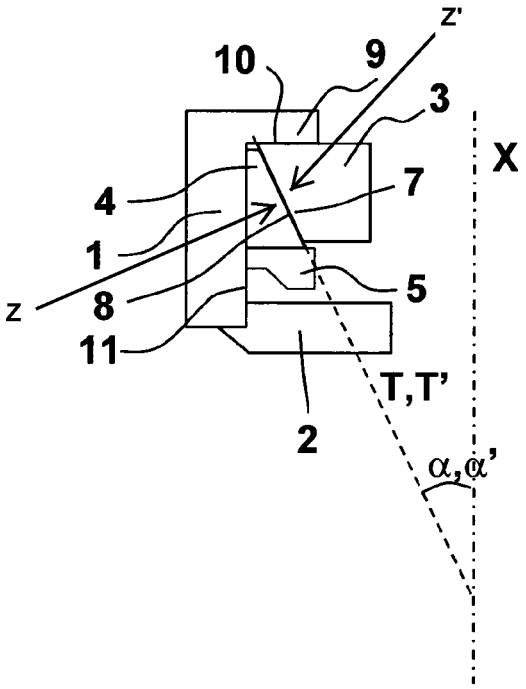

| | | | | |
|---|---|---|---|---|
| 787,637 | A * | 4/1905 | Porter | 368/300 |
| 2,350,651 | A * | 6/1944 | Taubert et al. | 368/276 |
| 3,735,584 | A | 5/1973 | Tokunaga | |
| 5,825,722 | A | 10/1998 | Meyrat et al. | |
| 2003/0016591 | A1 * | 1/2003 | Meyrat et al. | 368/309 |
| 2008/0225650 | A1 * | 9/2008 | Muller et al. | 368/310 |
| 2009/0016175 | A1 * | 1/2009 | Anderson | 368/223 |
| 2009/0103400 | A1 | 4/2009 | Grandperret | |
| 2009/0245032 | A1 * | 10/2009 | Bonnet et al. | 368/297 |
| 2010/0164818 | A1 * | 7/2010 | Kusunoki et al. | 343/718 |
| 2012/0002513 | A1 * | 1/2012 | Behrend et al. | 368/286 |
| 2012/0120779 | A1 * | 5/2012 | Altenhoven et al. | 368/300 |

FOREIGN PATENT DOCUMENTS

| | | | |
|---|---|---|---|
| CH | 471 412 | A | 12/1968 |
| CH | 541 174 | A | 5/1973 |
| EP | 0 770 939 | A1 | 5/1997 |
| EP | 1 840 679 | A1 | 10/2007 |
| EP | 1 970 779 | A1 | 9/2008 |
| FR | 1 541 847 | A | 10/1968 |
| FR | 1 545 700 | A | 11/1968 |
| JP | S47-037467 | A | 12/1972 |

OTHER PUBLICATIONS

Chinese Office Action dated Jan. 7, 2015, issued in the counterpart Chinese application No. 201180056883.2 (w/English translation) (19 pages).

Japanese Office Action dated Nov. 4, 2015 in counterpart JP application No. 2013-540197; English translation only (total 5 pages); CH280886 also cited in the Japanese Office Action was listed in a previous IDS.

* cited by examiner

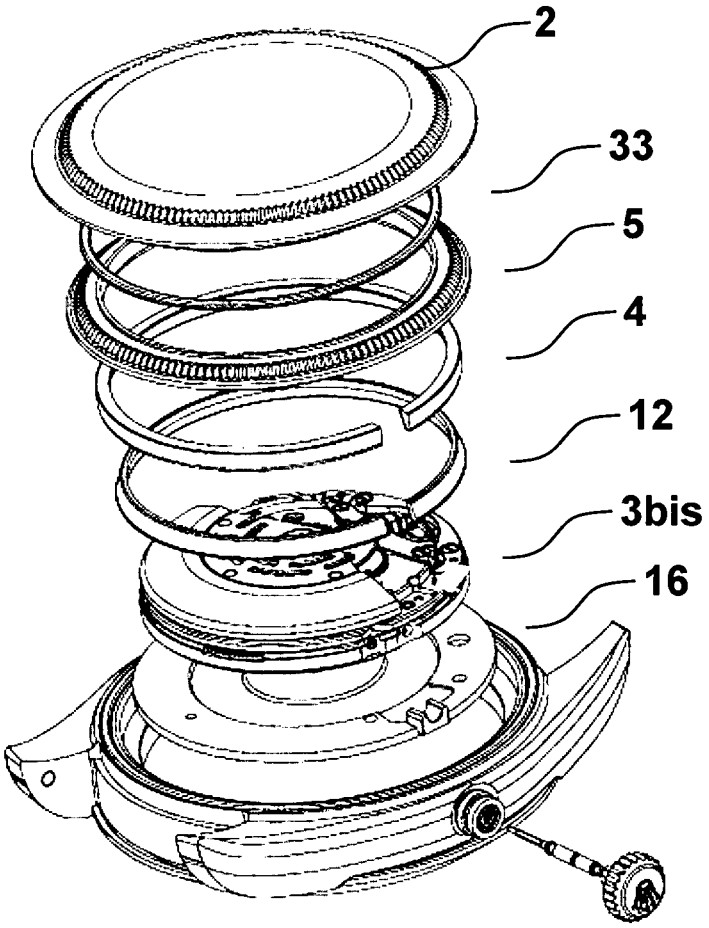
Fig. 5bis

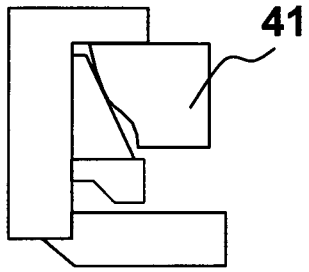
Fig. 14
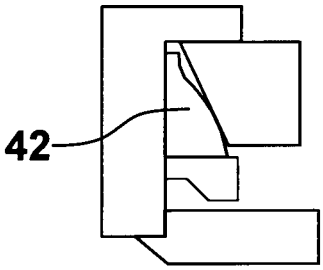
Fig. 14bis
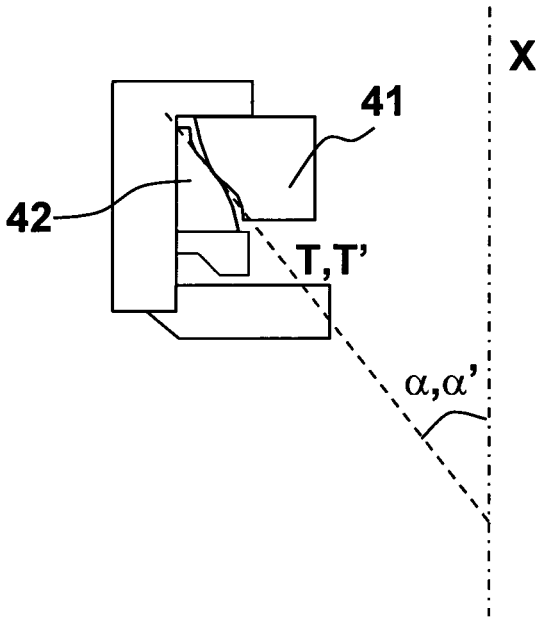
Fig. 14ter

WATCH WITH A RIGID CASING-UP, AND CASING-UP METHOD

The invention relates to a watch with a rigid casing-up and to a method for casing-up such a watch.

BACKGROUND OF THE INVENTION

The casing-up of a movement, that is to say securing the movement in the case of a watch, is generally accomplished by means of braces screwed to the movement, which braces are inserted into a groove provided on the inner periphery of the case, or with the help of a casing-up ring.

It is proposed in European patent application EP 1 970 779 to undertake the casing-up by utilizing two superimposed casing-up rings, between which the movement is retained. These rings are themselves compressed between a part of the middle of the watch and the bottom of the said watch. One of the rings is provided with an opening to permit the passage of a winding stem. An annular joint is provided for the axial and radial retention of this second ring and, consequently, the movement.

Various tests, including those undertaken by the applicant, have revealed that these casing-up solutions not only transmit a shock from the case to the movement, but also amplify it. Accordingly, a cased-up movement in a watch which experiences a shock of 10,000 g will be subjected to a shock of 25,000 g, that is to say amplified by a factor of 2.5.

One solution could involve inserting a shock absorber, such as an elastomer ring, between the case and the movement, although this will require the availability of a large volume inside the case.

SUMMARY OF THE INVENTION

The main object of the invention is to propose a watch having an improved resistance to shocks.

Surprisingly, it has been discovered that, rather than weakening the case by resorting to a shock absorber, entirely satisfactory results could be achieved by making it more rigid.

The object of the invention is thus a watch having a rigid case comprising:

- a middle;
- a bottom;
- a movement, and
- a casing-up ring in contact with the middle;

in which:

- the casing-up ring has an inner peripheral face, of which the profile comprises at least one zone Z, the tangent T to which forms a non-zero angle $\alpha$ of less than 90 degrees with the axis X passing through the center of the movement and perpendicular to the plane formed by the latter;
- the movement is integral with an outer peripheral face, of which the profile comprises at least one zone Z', the tangent T' to which forms a non-zero angle $\alpha'$ of less than 90 degrees with the said axis X;
- the said inner and outer peripheral faces being in contact with each other in the Z and Z' regions thereof;

the said watch being characterized in that it also comprises a tightening element provided for exerting pressure on the casing-up ring or the movement.

Such a casing-up possesses the special feature of applying a radial pressure and an axial pressure simultaneously to the movement, that is to say it combines axial tightening (in a direction parallel to the axis passing through the center of the movement, perpendicular to the latter and connecting the bottom to the watch crystal) with radial tightening.

It thus increases the rigidity of the casing-up, which provides the following advantages in particular:

- a spectacular reduction, that is to say 60% compared to a traditional casing-up with braces, in the acceleration experienced by the movement, for example in the event of a shock on a hard surface;
- elimination of the risks of collision between the movement and the middle in the event of a shock;
- elimination of the casing-up elements which break as the result of severe shocks (screws, flange screws, braces); and
- greater reliability of the casing-up.

Such a solution is completely unexpected, in view of the fact that current attempts aimed at increasing the resistance of watches to shocks are oriented towards diametrically opposed concepts, namely making the connection between the middle and the movement elastic and utilizing polymers to absorb the energy of the shock.

Furthermore, the invention also relates to a method for casing-up a watch according to the invention.

This method comprises the following stages:

a) introduction of the movement into the middle;

a') where appropriate, installation of an auxiliary casing-up ring around the movement;

b) installation of the casing-up ring around the movement; and c) where appropriate, installation of a tightening element.

Other characteristics and advantages of the invention are now outlined in detail below in the disclosure of various embodiments, the characteristics of which may be combined, except, of course, in the case of technical incompatibility.

Figure 2:
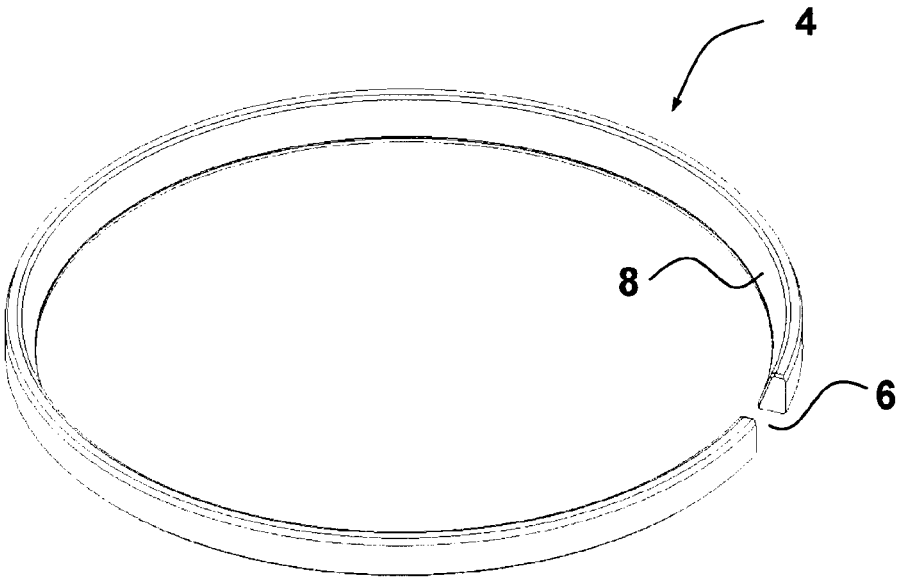
Figure 3:
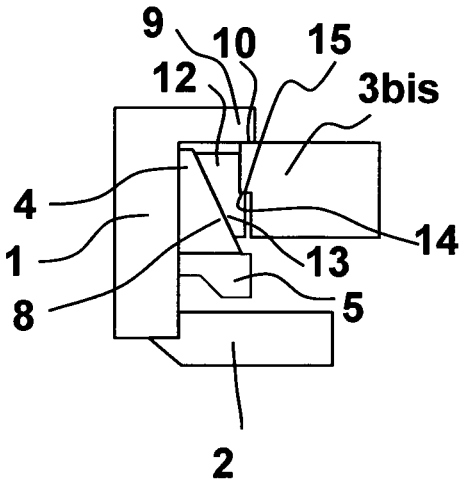
Figure 4:
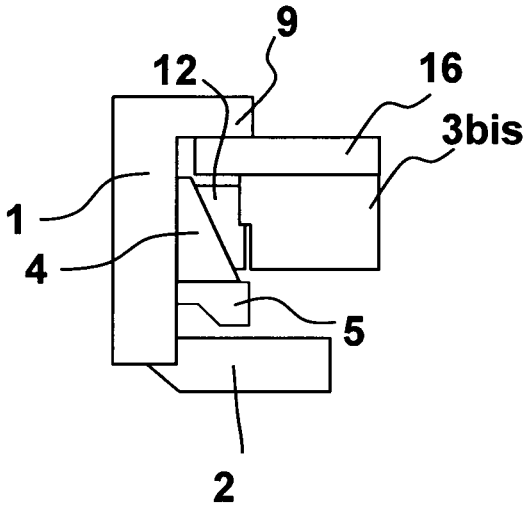
Figure 5:
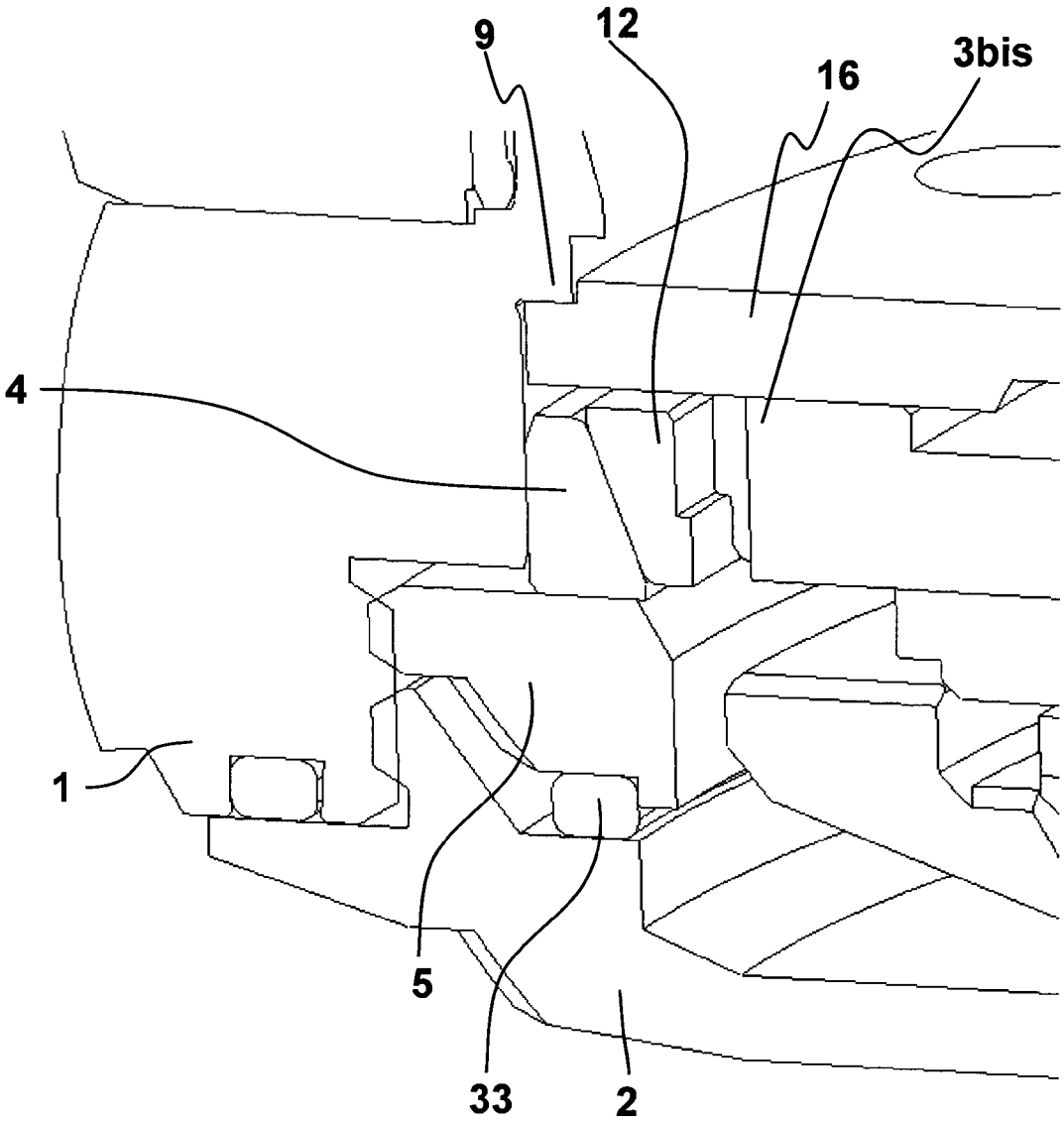
Figure 10:
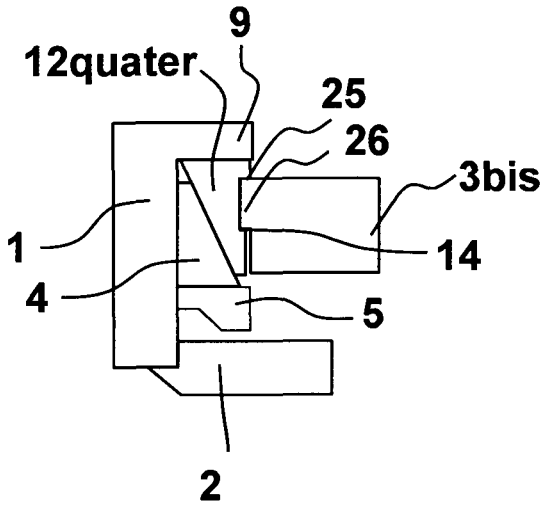
Figure 11:
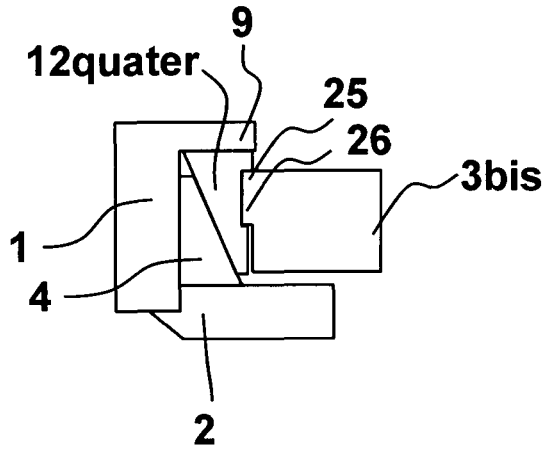
Figure 12:
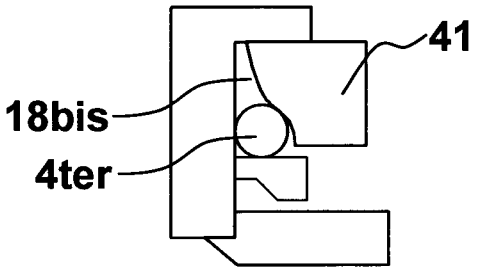
Figure 13:
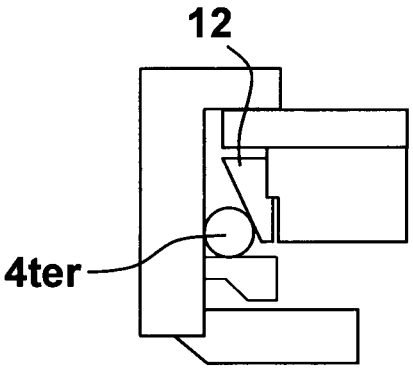
Figure 15:
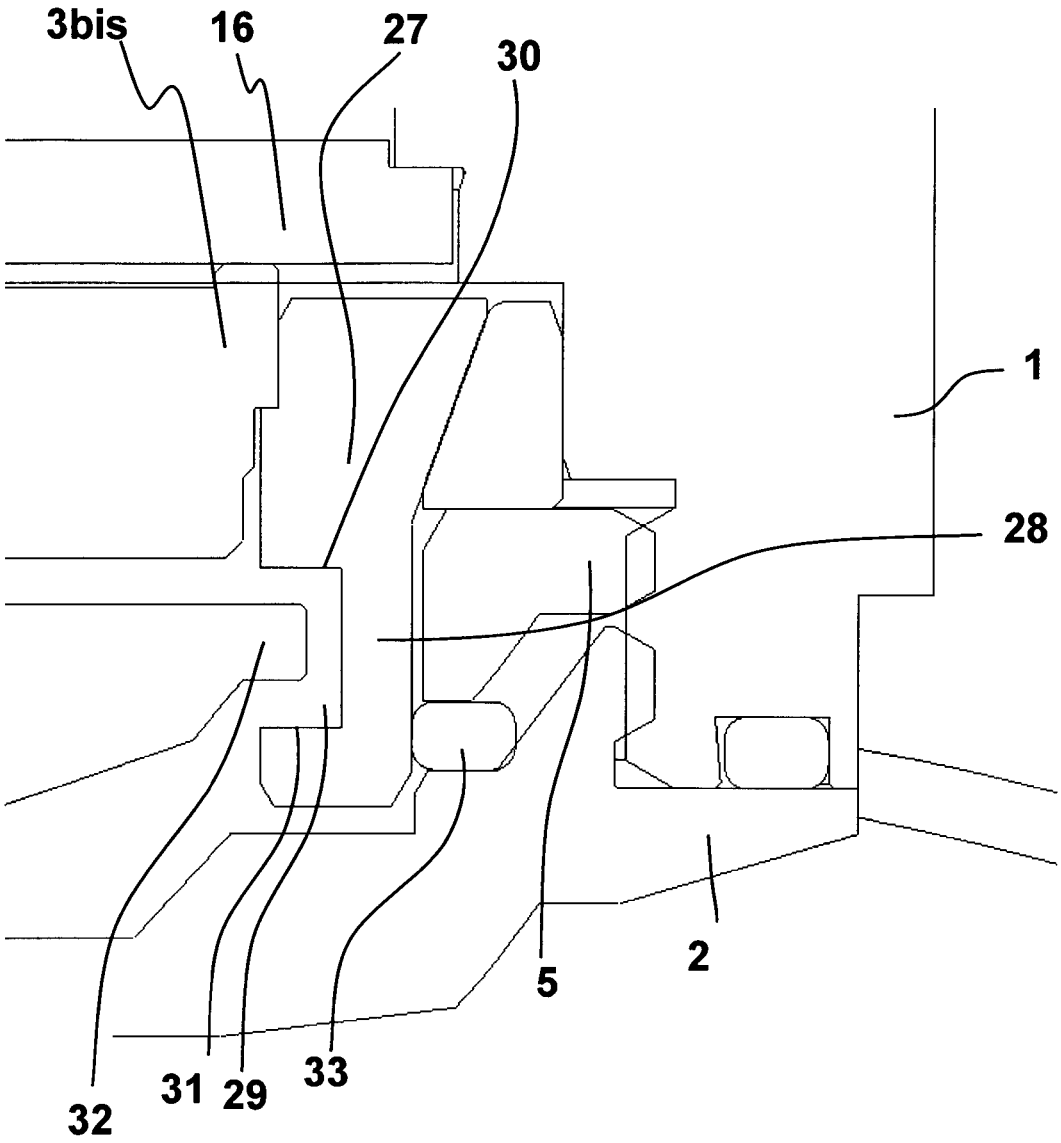
Figure 16:
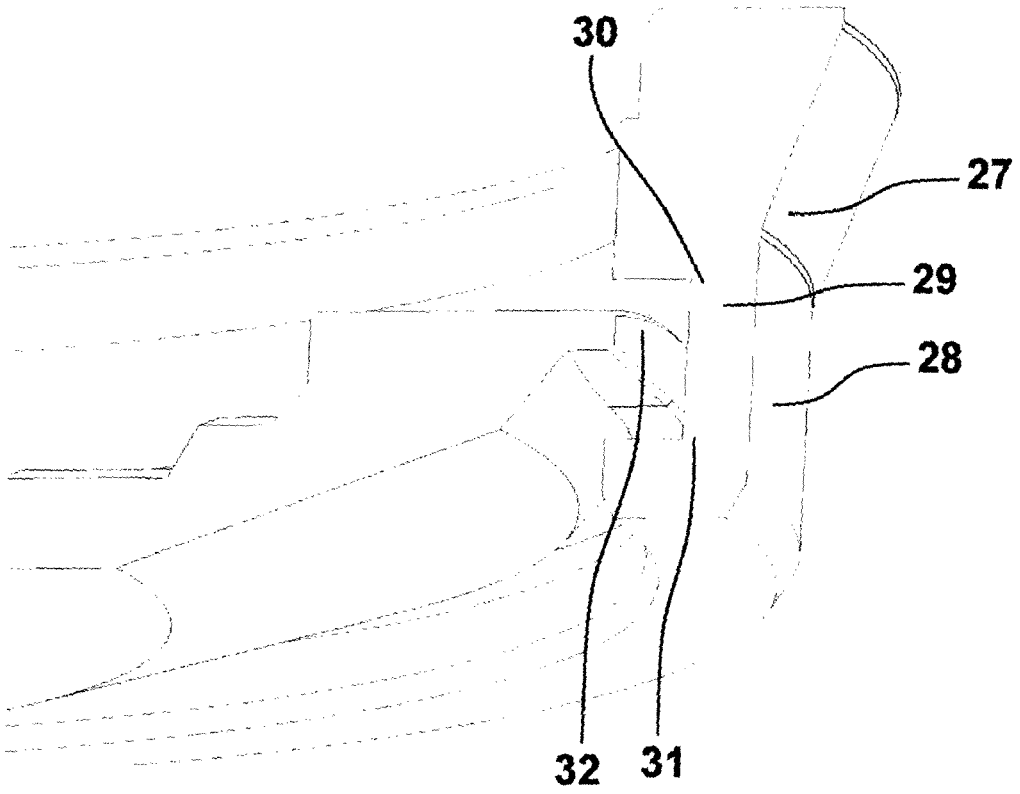
Figure 17:
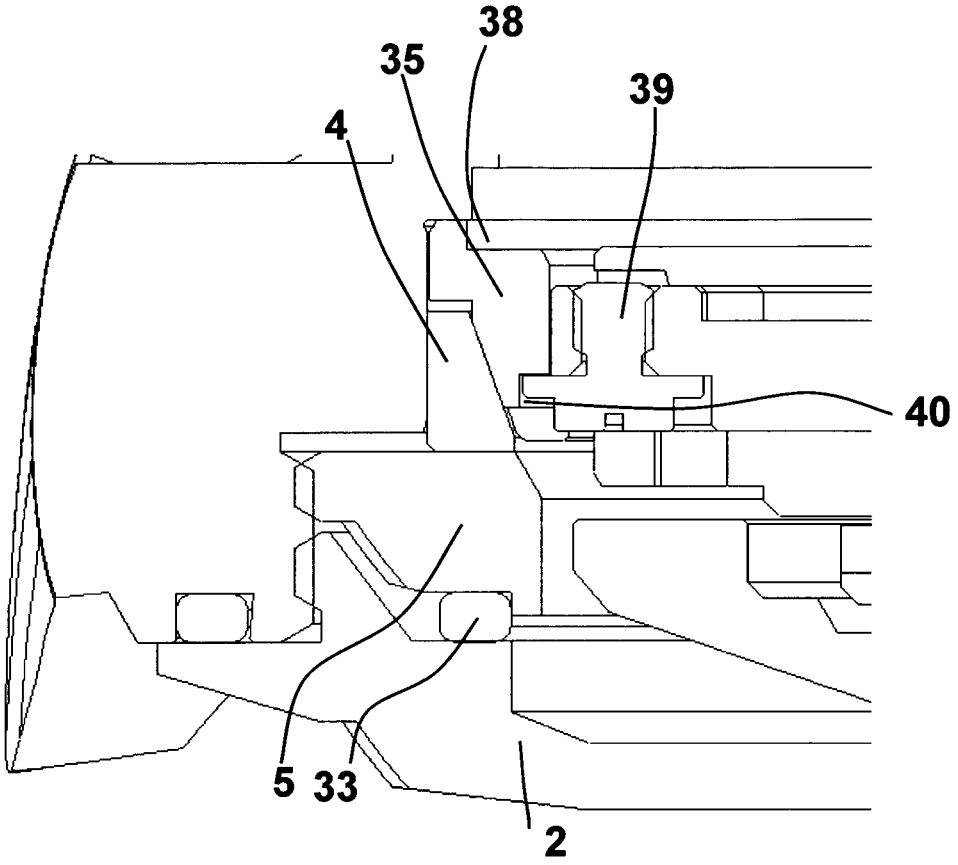
Figure 18:
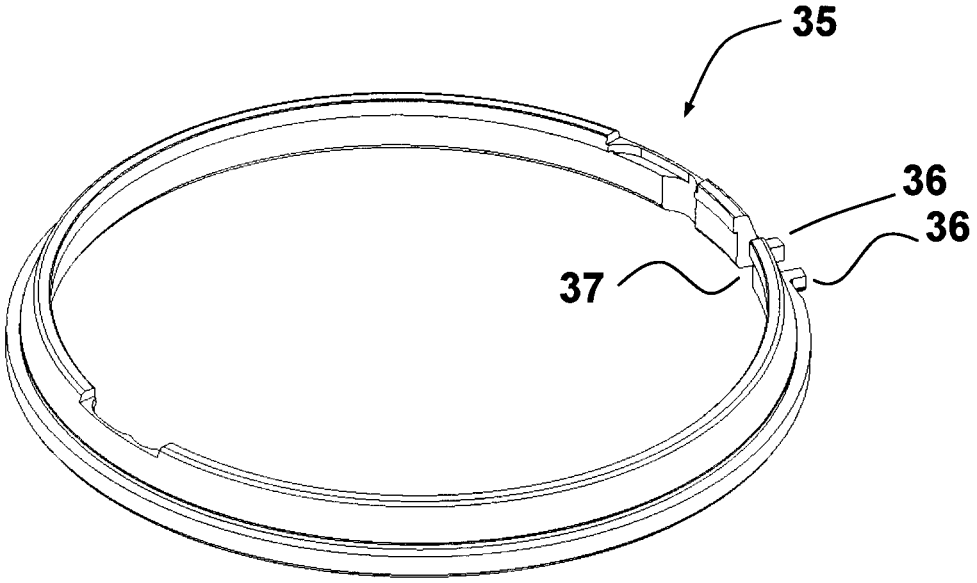
Figure 19:
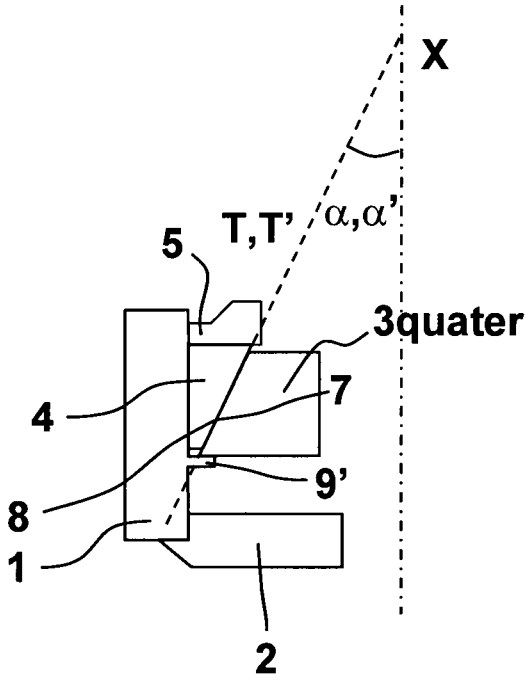

These embodiments refer to the accompanying figures, which represent schematically:

FIG. 1: a first embodiment of the invention, in cross-section;

FIG. 2: the detail of a split casing-up ring utilized in the first embodiment of the invention;

FIG. 3: a second embodiment of the invention, in cross-section;

FIG. 4: a third embodiment of the invention, in cross-section;

FIG. 5: a more complete drawing of the embodiment in FIG. 4, in cross-section;

FIG. 5*bis*: an exploded perspective view of the embodiment in FIGS. 4 and 5;

FIGS. 6 to 10: respectively, fourth, fifth, sixth, seventh and eighth embodiments of the invention, in cross-section;

FIG. 11: a variant without a tightening element of the embodiment in FIG. 10, in cross-section;

FIG. 12: a variant of the embodiment in FIG. 1, in cross-section;

FIG. 13: a variant of the embodiment in FIG. 4, in cross-section;

FIGS. 14, 14*bis* and 14*ter*: other variants of the embodiment in FIG. 1, in cross-section;

FIG. 15: a ninth embodiment of the invention, in cross-section;

FIG. 16: a detail of the ninth embodiment of the invention, in cross-section;

FIG. 17: a tenth embodiment of the invention, in cross-section;

FIG. 18: a split auxiliary casing-up ring utilized in the tenth embodiment of the invention;

FIG. 19: a variant of the embodiment in FIG. 1, in cross-section; and

Figure 20:
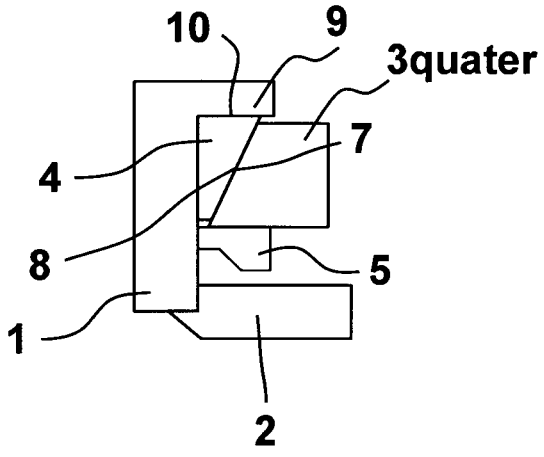

FIG. 20: another variant of the embodiment in FIG. 1, in cross-section.

DETAILED DISCLOSURE OF THE INVENTION

Partially illustrated in FIG. 1 is a first embodiment of a watch with a rigid casing-up according to the invention.

This watch comprises a middle 1, a removable bottom 2, a movement 3, a casing-up ring 4 and a tightening element 5.

The casing-up ring for the movement 4 generally consists of a rigid and non-elastomeric material typically possessing a Young modulus greater than 0.1 GPa and preferably greater than 50 GPa.

It is illustrated in more detail in FIG. 2. It preferably comprises a split 6 for the purpose of interrupting its periphery. The split 6 permits the elastic deformation of the ring to be improved, the free extremities bordering the split 6 being able to move closer to each other in such a way as to reduce the inner diameter of the ring. In addition, the split 6 permits the passage of a watch component such as a winding stem. The casing-up ring 4 also comprises an inner truncated cone-shaped peripheral face 8.

The expression "inner face" is used in the present disclosure to denote a face facing towards the center of the ring, and thus of the movement.

The movement 3, of which a part may be seen in FIG. 1, comprises an outer peripheral face 7 intended to be in contact with the inner truncated cone-shaped peripheral face 8 of the split casing-up ring 4.

The expression "outer face" is used in the present disclosure to denote a face facing away from the center of the ring, and thus away from the center of the watch.

In FIG. 1, the tightening element 5 is in the form of a ring resting against the split casing-up ring and provided on its outer periphery with a thread interacting with a corresponding tapping provided on an axial inner face 11 of the middle 1.

The middle 1 comprises a part 9 projecting radially towards the center. The movement 3 is in contact with an inner face 10 of the part 9, which acts as an abutment.

The cross-sectional view in FIG. 1 shows that the tangent T to the rectilinear profile (or generator) of the inner peripheral face 8 of the casing-up ring 4 forms a non-zero angle $\alpha$ with the general axis of the watch, namely the longitudinal axis X passing through the center of the movement 3 and perpendicular to the plane formed by the latter.

In FIG. 1, the opening of the angle $\alpha$ is present on the side opposite the bottom 2 of the watch, that is to say that its vertex is situated on the side of the bottom 2 of the watch, and not on the side of a cover or a dial (not illustrated in the figure), which would be situated close to the part 9 of the middle 1.

The movement 3 is integral with an outer peripheral face 7. In the embodiment depicted in FIG. 1, the outer peripheral face 7 is arranged directly on the movement 3 itself, for example on the plate.

The tangent T' to the rectilinear profile of this peripheral outer face 7 forms an angle $\alpha'$ with the axis X.

In order to ensure the correct operation of the system, the inner 8 and outer 7 peripheral faces are in contact with one another and form essentially identical angles $\alpha$ and $\alpha'$ with the axis X. As a result, the tangents T and T' coincide substantially.

As may be appreciated in FIG. 19, as a variant, the inclination of the outer 7 and inner 8 peripheral faces may be inverted, the angles $\alpha$ and $\alpha'$ then opening towards the bottom 2. The assembly/casing-up may then take place via the dial side, the flange then being able to serve as a tightening element 5. In this case, an abutment 9' must be provided on the side of the movement opposite the tightening element, which abutment may also be formed by the bottom.

Another alternative illustrated in FIG. 20 is to cause the tightening element 5 to interact with the movement 3*quater*, the displacement of the tightening element then being applied directly to the movement. A supplementary variant involves the integration of the casing-up ring directly with the middle, for example by providing the middle with an inner peripheral face exhibiting a truncated cone-shaped profile.

The angles $\alpha$ and $\alpha'$ are generally at least 5 degrees, as it is otherwise difficult to extract the movement during disassembly because of friction and adhesion.

They must also not exceed 45 degrees, as the effectiveness of the axial tightening is otherwise reduced because of the need for a large vertical displacement in order to bring about low radial tightening.

The angles $\alpha$ and $\alpha'$ preferably lie between 15 and 25 degrees.

Thus, as may be readily appreciated by examining FIG. 1, the displacement of the threaded ring 5 towards the top of the figure, that is to say towards the ring 4, is brought about by causing the threaded ring 5 to rotate in the appropriate direction. The ring then moves in turn towards the top and approaches closer to the inner face 10 of the part 9 of the middle.

This tightening of the ring 4 has two effects, thanks to the interaction between the combined truncated cone-shaped profiles of the casing-up ring 4 and the movement 3. On the one hand, it produces a radial compression of the movement 3, facilitated by the presence of the split 6 in the ring, and on the other hand, an axial compression of the movement 3, which presses the latter against the projecting part or abutment 9 of the middle 1.

A second embodiment of the invention is illustrated in FIG. 3.

In this embodiment, the movement 3*bis* is still integral with an outer truncated cone-shaped peripheral face 13. However, this integrality is no longer manifested in the presence of the outer truncated cone-shaped peripheral face 13 on the movement 3*bis* itself, but in the interposition of an auxiliary casing-up ring 12, which is itself integral with the movement 3*bis*.

This auxiliary movement casing-up ring 12 generally consists of a rigid and non-elastomeric material typically exhibiting a Young modulus greater than 0.1 GPa and preferably greater than 50 GPa.

The periphery of the auxiliary casing-up ring 12 is preferably interrupted by a split (not visible in FIG. 3, but visible in FIG. 18).

Preferably, the split in the auxiliary casing-up ring 12 is oriented in such a way as to be in alignment with the split 6 in the casing-up ring 4, in order for the two splits to form an opening for a winding stem.

Furthermore, in this embodiment, the movement 3*bis* exhibits on its circumference a shoulder 15 intended to abut a shoulder 14 provided on an inner peripheral face of the auxiliary casing-up ring 12.

Thus, when the threaded ring 5 is tightened, it bears against the casing-up ring 4, which pushes the auxiliary casing-up ring 12 towards the center of the watch. Thanks to the axial contact between the auxiliary casing-up ring 12 and the perimeter of the movement 3*bis*, the latter is compressed towards the center for the whole of its periphery.

Furthermore, tightening of the threaded ring 5 causes the displacement of the casing-up rings 4 and 12 in an upward direction in the figure and, thanks to the contact between the shoulder 14 of the auxiliary casing-up ring 12 and the shoulder 15 of the movement 3*bis*, the latter is compressed against the inner face of the part 9 of the middle 1 which acts as an abutment.

A third embodiment of the invention is illustrated in FIG. 4. The only difference between this embodiment and the second embodiment is that a cover 16 is interposed between the movement 3*bis* and the part 9 of the middle 1. The cover 16 then forms an abutment for the movement.

This cover 16 preferably comprises a detent pin (not illustrated), which engages in a socket provided in the middle 1 with the aim of preventing rotation of the cover 16. Since the movement 3*bis* is screwed to the cover, the detent pin also guarantees the orientation of this movement in relation to the middle 1.

FIG. 5 is a more complete illustration of the watch according to FIG. 4. The cover 16 may be, for example, a face, a screen to reduce the effect of the magnetic field on the movement, or a calendar ring. FIG. 5 also shows an annular joint 33 arranged between the bottom 2 and the threaded ring 5, which permits unscrewing of the threaded ring to be avoided.

FIG. 5*bis* is an exploded perspective view of a watch according to FIG. 5.

Figure 6:
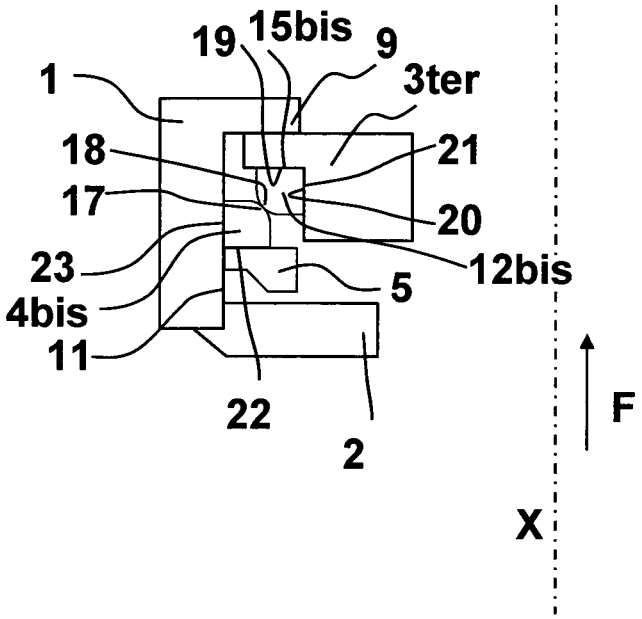

FIG. 6 illustrates a fourth embodiment of the invention.

The concept of the invention is realized here in a different form, namely that the interaction between the two combined head-to-tail conical profiles of the embodiments in FIGS. 1, 3, 4 and 5 is replaced by an interaction between two rounded parts which face towards one another and are in contact with one another.

These rounded parts constitute inner and outer peripheral faces. They may be in the form of the arc of a circle, the arc of an ellipse or any other curve considered to be appropriate by a person skilled in the art.

Thus, as may be appreciated from FIG. 6, the casing-up ring 4*bis* exhibits an axial section formed from two parts 17 substantially in the form of quarters of a disc, of which one only is visible in the figure, the other being capable of being imagined symmetrically in relation to the axis X.

An auxiliary casing-up ring 12*bis*, which may exhibit substantially the same form as the casing-up ring 4*bis*, is in contact with the rounded part 17 of the latter via its rounded part 18.

The rings 4*bis* and 12*bis* are split in this embodiment. Although it is conceivable for them to have the same inner diameter, which would not prevent them from interacting due to the fact that they are split, the inner diameter of the ring 4*bis* is preferably greater than that of the ring 12*bis*.

The ring 3*bis* is arranged in a corner formed by the threaded ring 5 and the axial inner face 11 of the middle 1. The two non-rounded faces 22 and 23 of the ring Obis respectively bear against the threaded ring 5 and against the axial inner face 11 of the middle 1.

The ring 12*bis* is arranged in a corner of the movement 3*ter*, the said corner being formed by a shoulder 15*bis* and by an axial outer peripheral face 21. The two non-rounded faces 19 and 20 of the ring 12*bis* respectively bear against the shoulder 15*bis* of the movement 3*ter* and against the axial outer peripheral face 21 of the movement 3*ter*.

The rings 4*bis* and 12*bis* are offset in relation to one another along the axis X. When the threaded ring 5 is tightened, it is displaced according to the arrow F and also pushes the ring 4*bis* in the direction of the arrow F. The rounded part 17 of the ring 4*bis* then slides on the rounded part 18 of the ring 12*bis*, forcing the latter to move simultaneously towards its center and towards the part 9 of the middle 1. The rounded part of the auxiliary ring may also be integrated directly into the plate of the movement, in a similar manner to the embodiment in FIG. 1.

Figure 7:
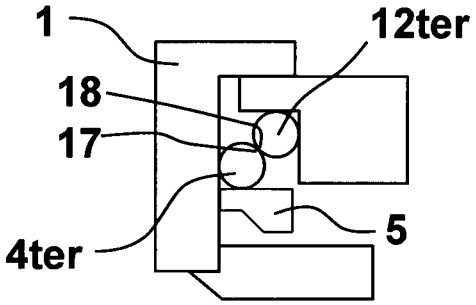

Illustrated in FIG. 7 is a fifth embodiment, which is a simple variant of the embodiment in FIG. 6. Here, the rings 4*ter* and 12*ter* respectively play the same role as the rings 4*bis* and 12*bis* in FIG. 6, although they are totally rounded, that is to say they exhibit a toroidal shape.

Figure 8:
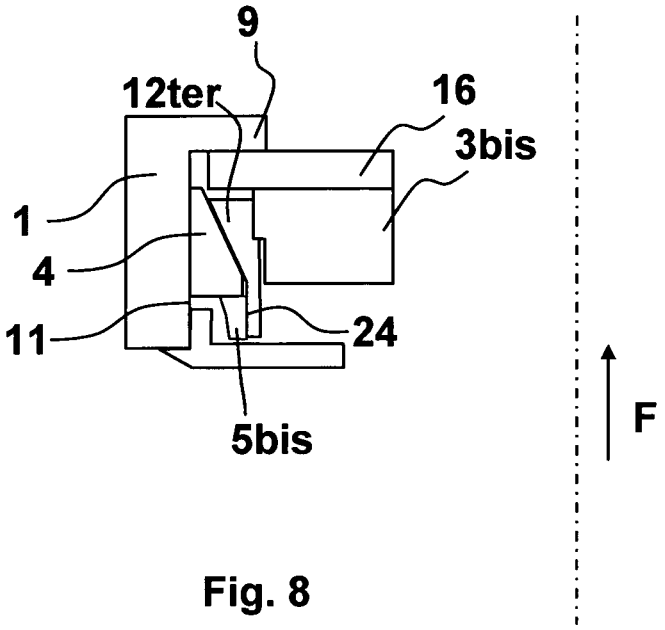

Illustrated in FIG. 8 is a sixth embodiment of the invention. This embodiment exhibits two major differences compared to that of FIG. 3: the auxiliary casing-up ring 12*ter* comprises an axial prolongation, of which the axial outer peripheral face 24 is threaded. The tightening element is still a threaded ring 5*bis*, although its threading is now internal. It is thus a tapping interacting with the threading of the ring 12*ter*. There is thus no longer a requirement for the inner face 11 of the middle 1 to be threaded.

A cover 16 (for example a dial or a screen) is interposed between the movement 3*bis* and the projecting part 9 of the middle 1.

The threaded ring 5*bis* in this case must be screwed in order for the ring 4 to move in the direction of the arrow F. This assures radial tightening, the axial tightening being obtained by friction against the movement and the ring.

Figure 9:
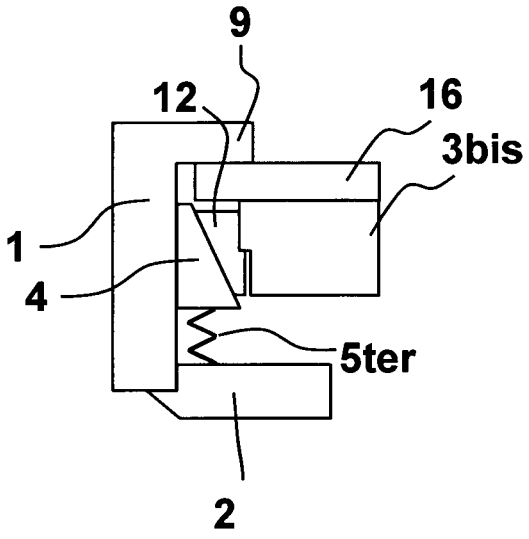

Illustrated in FIG. 9 is a seventh embodiment of the invention.

This embodiment exhibits one major difference compared to that of FIG. 4. The tightening element in this case is an elastic element 5*ter*, such as a spring, bearing against the bottom 2 of the watch case.

Illustrated in FIG. 10 is an eighth embodiment of the invention.

In this embodiment, which closely resembles that in FIG. 3, the auxiliary split casing-up ring 12*quater* comprises an auxiliary shoulder 25, in addition to the shoulder 14, similar to that of the ring 12 in FIG. 3.

The shoulder 14 and the auxiliary shoulder 25 thus form a throat, accommodated in which is the part 26 of the movement 3*bis* which has the largest diameter. The part 26 is inserted into this throat with an interference fit, such that, when the threaded ring 5 is screwed, the ring 12*quater* carries the movement 3*bis* with it in an integral manner in the axial direction and compresses it in an integral manner in the radial direction. The axial tightening is achieved by the friction between the ring 12*quater* and the part 26. The movement may be inserted into the throat of the ring, either by deforming the split ring, or by the provision of a bayonet coupling system.

Illustrated in FIG. 11 is a variant without a tightening ring of the embodiment in FIG. 10, in which the bottom 2 serves as a tightening element. In a similar configuration, the outer ring 4 could be threaded on its outer perimeter and could act as a tightening element.

Illustrated in FIG. 12 is a variant of the embodiment in FIG. 1, in which the movement 41 exhibits an inward-curved outer peripheral face 18*bis*, and the casing-up ring 4*ter* exhibits a toroidal shape.

Illustrated in FIG. 13 is a variant of the embodiment in FIG. 4 having a casing-up ring 4*ter* exhibiting a toroidal shape.

Illustrated in FIG. 14 is another variant of the embodiment in FIG. 1, in which the movement 41 exhibits an inward-curved outer peripheral face.

Illustrated in FIG. 14*bis* is another variant of the embodiment in FIG. 1, in which the casing-up ring 42 exhibits an inward-curved inner peripheral face.

Illustrated in FIG. 14*ter* is another variant of the embodiment in FIG. 1, in which the movement 41 and the casing-up ring 42 respectively exhibit an inward-curved outer peripheral face and an inward-curved inner peripheral face.

As can be appreciated from FIGS. 12, 13, 14, 14*bis* and 14*ter*, the following common characteristics are always present:

the casing-up ring has an inner peripheral face, of which the profile, as observed in longitudinal section according to the axis X, comprises at least one zone Z (not designated), the tangent T to which forms a non-zero angle α together with the axis (X);

the movement is integral with an outer peripheral face, which is situated either on the movement itself or on an auxiliary casing-up ring, which is itself integral with the movement, the profile of this outer peripheral face, as observed in longitudinal section according to the axis X, comprising at least one zone Z' (not designated), the tangent T' to which forms a non-zero angle α' together with the axis X;

the inner and outer peripheral faces are in contact with each other via their zones Z and Z', the tangents T and T' to these zones coinciding, that is to say the respective angles α and α' which they form with the axis X are identical, or at least similar, in an ideal case.

As can be appreciated in FIGS. 12, 14, 14*bis* and 14*ter*, the zones Z and Z' may be reduced significantly to a point, whereas in the embodiment in FIG. 1, specifically, they extend over the entirety of the respective profiles of the inner and outer peripheral faces.

In other words, in the case of FIGS. 12, 14, 14*bis* and 14*ter*, the angles α and α' vary as a function of the tightening and of the position of the zones Z and Z'. In addition, the contact surfaces may be provided prior to assembly with tangents forming an angle α which is different from the angle α', in such a way as to take into consideration any deformation at the time of assembly.

As a variant, it is also possible for the tightening element to act not only on the casing-up ring, but also on the movement. In this case, the orientation of the angle α, α' must be inverted, so that the pressure exerted by the ring induces radial and axial tightening of the movement. The different variants may, of course, be combined with one another, to the extent that they are compatible.

The preferred solution is for the tightening element to act upon and apply a pressure to the casing-up ring, with an abutment arranged to the side of the movement opposite the tightening element, in order to generate radial and axial tightening of the movement.

Illustrated in FIGS. 15 and 16 is a ninth embodiment, which is similar to that in FIG. 4.

The auxiliary casing-up ring 27 comprises an axial extension 28 situated on the opposite side axially to the dial in this case and provided with a throat 29 over the entire periphery of its inner axial face.

The threaded ring 5 in this case has an internal diameter that is sufficiently large to accommodate the axial extension 28.

As can be appreciated more readily in FIG. 16, the function of the throat 29 is to accommodate the outer lip 32 of a weight for an automatic winding module and to limit its displacement in the event of a shock. The radial end faces 30 and 31 of the throat 29 in fact act as abutments for the outer lip 32 of the weight. This has the advantage of preventing the plastic deformation of the weight support and eliminates the risk of marking the bridges, the plate and the bottom 2.

An anti-unscrewing joint 33 (also visible in FIG. 5) is preferably provided in order to prevent unscrewing of the threaded ring 5.

Illustrated in FIG. 17 is a tenth embodiment, which is a variant of that without a cover in FIG. 10.

With the aim of reducing the number of component parts in the watch, a split auxiliary casing-up ring 35 is provided to adopt the different functions of the cover (interface with the middle, indexation of the movement and axial abutment).

The split auxiliary casing-up ring 35 is visible in FIG. 18, where it has been reversed relative to its position in FIG. 17.

Tabs 36 are provided around the split 37 in order to ensure the indexation of the movement. As a variant, they can be replaced by a pin driven into the middle and which interacts at least with the split auxiliary casing-up ring 35.

A bore 38, which is visible in FIG. 17, has been provided on the side opposite the threaded ring 5 in order to accommodate a dial.

Retention of this ring during assembly is assured by the fixing screws 39 accommodated in a groove 40, which no longer perform an active function of retaining the movement once the casing-up has been carried out.

The casing-up thus comprises the split casing-up ring 4, the split auxiliary casing-up ring 35, the threaded ring 5 and, optionally, an anti-unscrewing joint 33.

The axial retention of the movement is assured by axial tightening and by friction.

This variant makes it possible to dispense with the cover, which is a voluminous component part and is subjected to severe aesthetic constraints, as well as with the anti-rotation detent pin to be welded to the cover.

Casing-Up Method

The casing-up of the movement of a watch according to the first embodiment of the invention comprises in particular the following successive stages:

a) introduction of the movement into the middle;

b) installation of the casing-up ring, if necessary split, around the movement; and c) where appropriate, installation of the tightening element.

As a variant, stages a) and b) may be reversed.

The casing-up of the movement of a watch according to the other embodiments comprises in addition, between stages a) and b), a stage a') involving the installation of the auxiliary casing-up ring, if necessary split, around the movement.

In the case of the embodiment in FIGS. 15 and 16, in which the throat 29 provides abutments for the oscillating mass, the method may comprise in addition a stage of inserting the said mass into the throat 29, followed by a stage in which it is made integral with the movement in a manner that is known per se.

The invention claimed is:

1. A watch with a rigid casing-up, comprising:

a middle;

a bottom;

a movement;

a casing-up ring in contact with the middle; and a tightening element;

in which:

the casing-up ring has an inner peripheral face, wherein a profile of the inner peripheral face of the casing-up ring comprises at least one zone Z, the tangent (T) to which forms a first non-zero angle (α) of less than 90 degrees with an axis (X) passing through a center of the movement and perpendicular to a plane formed by the movement;

the movement has an outer peripheral face, wherein a profile of the outer peripheral face of the movement comprises at least one zone Z', the tangent (T') to which forms a second non-zero angle (α') of less than 90 degrees with the axis (X);

the inner and outer peripheral faces are in contact with each other in the Z and Z' zones, the tightening element is configured to apply a pressure on at least one of the movement and the casing-up ring, and in an assembled state of the watch, one of the movement and the casing-up ring is position-adjustable in an axial direction by frictional sliding contact between the zones Z and Z', and the other one of the movement and the casing-up ring is blocked against an abutment, so that the movement is subject to an adjustable tightening pressure in simultaneously the axial direction and a radial direction.

2. The watch as claimed in claim 1, in which the angles ($\alpha$) and ($\alpha'$) are substantially identical.

3. The watch as claimed in claim 1, in which the angles ($\alpha$) and ($\alpha'$) lie between 5 and 45 degrees.

4. The watch as claimed in claim 1, in which the casing-up ring has a split.

5. The watch as claimed in claim 1, in which the movement comprises an auxiliary casing-up ring, and the outer peripheral face of the movement is defined by an outer peripheral face of the auxiliary casing-up ring.

6. The watch as claimed in claim 5, in which the auxiliary casing-up ring has a split.

7. The watch as claimed in claim 5, in which the casing-up ring and the auxiliary casing-up ring are of toroidal shape.

8. The watch as claimed in claim 5, in which the auxiliary casing-up ring comprises a throat of which the radial faces are adapted to serve as an abutment, in particular for an outer lip of a weight for an automatic winding module.

9. The watch as claimed in claim 1, in which a shape of the inner peripheral face of the casing-up ring is a truncated cone, rounded, or curved inwards.

10. The watch as claimed in claim 1, in which a shape of the outer peripheral face of the movement is a truncated cone, rounded or curved inwards.

11. The watch as claimed in claim 1, in which the tightening element comprises a threaded or tapped ring.

12. The watch as claimed in claim 1, additionally comprising an anti-unscrewing joint in contact with the tightening element.

13. The watch as claimed in claim 1, in which the watch is without a cover, and the movement is in contact with the middle.

14. The watch as claimed in claim 1, additionally comprising a cover, the movement being in contact with the cover.

15. The watch as claimed in claim 1, in which the tightening element is configured to apply pressure to the casing-up ring.

16. The watch as claimed in claim 15, in which vertices of the angles $\alpha$ and $\alpha'$ lie on a side of the bottom of the watch.

17. The watch as claimed in claim 1, additionally comprising an abutment on a side of the movement opposite the tightening element.

18. The watch as claimed in claim 17, in which vertices of the angles ($\alpha$) and ($\alpha'$) lie on a side opposite the bottom of the watch.

19. A method for casing-up a movement of a watch as claimed in claim 1 in a middle, comprising:

a) introducing the movement into the middle;

b) installing the casing-up ring around the movement; and c) installing the tightening element, wherein the tightening element is configured to apply pressure to the casing-up ring or the movement.

20. The method as claimed in claim 19, in which the movement or the casing-up ring is pressed against an abutment.

21. The method as claimed in claim 19, further comprising installing an auxiliary casing-up ring around the movement.

22. The watch as claimed in claim 1, in which the movement or the casing-up ring is pressed against an abutment.

23. The watch as claimed in claim 1, wherein the casing-up ring comprises a rigid and non-elastomeric material.

24. The watch as claimed in claim 1, wherein the inner peripheral face of the casing-up ring is in frictional sliding contact with the outer peripheral face of the movement during tightening of the tightening element.

* * * * *